US005715749A

United States Patent [19]

Miller

[11] Patent Number: 5,715,749

[45] Date of Patent: Feb. 10, 1998

[54] APPARATUS FOR FACILITATING PRINTING CASSETTE REPLACEMENT

[75] Inventor: John Jarrett Miller, North Richland Hills, Tex.

[73] Assignee: Stevens International, Fort Worth, Tex.

[21] Appl. No.: 655,464

[22] Filed: May 30, 1996

[51] Int. Cl.[6] ..... B41F 5/00

[52] U.S. Cl. ..... 101/216; 101/477

[58] Field of Search ..... 101/216, 477, 101/DIG. 36

[56] References Cited

U.S. PATENT DOCUMENTS

| | | | |
|---|---|---|---|
| 3,173,361 | 3/1965 | Verlik | 101/216 |
| 3,470,816 | 10/1969 | Piecha et al. | 101/216 |
| 3,500,744 | 3/1970 | Lewis | 101/23 |
| 3,625,145 | 12/1971 | Heatley, Jr. | 101/142 |
| 3,876,087 | 4/1975 | Osta | 214/38 CC |
| 4,137,843 | 2/1979 | Ottenhue | 101/153 |
| 4,502,384 | 3/1985 | Habluetzel | 101/153 |
| 4,711,172 | 12/1987 | Capebosc | 101/152 |
| 4,934,264 | 6/1990 | Gansky et al. | 101/175 |
| 5,275,105 | 1/1994 | Schweizer et al. | 101/477 |
| 5,588,361 | 12/1996 | Riis | 101/216 |

FOREIGN PATENT DOCUMENTS

| | | | |
|---|---|---|---|
| 697501 | 9/1940 | Germany | 101/216 |

*Primary Examiner*—Edgar S. Burr
*Assistant Examiner*—Dave A. Ghatt
*Attorney, Agent, or Firm*—Tarolli, Sundheim, Covell, Tummino & Szabo

[57] ABSTRACT

A transfer cart (10) facilitates exchange of printing cassettes in a printing press (14), the printing cassettes have respective images to be printed. A first shelf (70) of the transfer cart (10) receives a replacement printing cassette (**12*b*) from a cassette storage facility (16). The transfer cart (10) has a base (60) with wheels (62) such that the transfer cart can be moved from the storage facility (16) to a location adjacent to the printing press (14). A second shelf (74) of the transfer cart (10) receives a replaceable printing cassette (12*a*) from the printing press (14) while the replacement cassette (12*b*) is retained on the first shelf (70). A lift mechanism (80) moves the first and second shelves (70, 74) between a position in which the second shelf can receive the replaceable cassette (12*a*) from the printing press (14) while the first shelf retains the replacement cassette (12*b*) and a position in which the printing press can receive the replacement cassette from the first shelf while the second shelf retains the replaceable cassette received from the printing press. Only a single round trip of the transfer cart (10) between the storage facility (16) and the printing press (14**) is needed to exchange the cassettes.

8 Claims, 4 Drawing Sheets

APPARATUS FOR FACILITATING PRINTING CASSETTE REPLACEMENT

BACKGROUND OF THE INVENTION

The present invention relates to printing presses, and particularly to offset printing presses which have one or more cylinders that are replaced to change the image to be printed by the printing press.

An offset printing press comprises plate, blanket and impression cylinders for rotation about respective axes. The plate cylinder has an image which is to be printed. Ink is applied to the image, and an ink image is transferred from the plate cylinder to the blanket cylinder and subsequently to the material to be printed as the material passes through a nip defined between the blanket and impression cylinders.

It is known to replace the plate cylinder within the printing press with another plate cylinder when the image to be printed is to be changed. During the plate cylinder replacement, the plate cylinder within the printing press is removed from the printing press and moved from the printing press to a storage facility. The removed plate cylinder is stored in the storage facility for later use again in the printing press. A replacement plate cylinder is removed from the storage facility and moved to the printing press. The replacement plate cylinder is then mounted into the printing press and the printing press is enabled for a subsequent printing run during which the image on the replacement plate cylinder is printed. The plate cylinder is part of an assembly known as a printing cassette.

SUMMARY OF THE INVENTION

The present invention is an apparatus for facilitating removal of one printing cassette from a printing press and mounting of a replacement printing cassette in the printing press. The printing cassettes include plate cylinders which have respective images to be printed on material during operation of the printing press. A first holding means of the apparatus receives a replacement printing cassette from a cassette storage facility. A transport means carries the first holding means and the replacement printing cassette received by the first holding means from the cassette storage facility to a transfer location adjacent to the printing press.

A second holding means receives a printing cassette from a cassette location in the printing press while the replacement printing cassette is retained by the first holding means. A mover means moves the first and second holding means between first and second positions. In the first position the second holding means can receive the printing cassette from the cassette location in the printing press while the first holding means retains the replacement printing cassette. In the second position the cassette location in the printing press can receive the replacement printing cassette from the first holding means while the second holding means retains the printing cassette received from the printing press.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF THE PREFERRED EMBODIMENT

Figure 1:
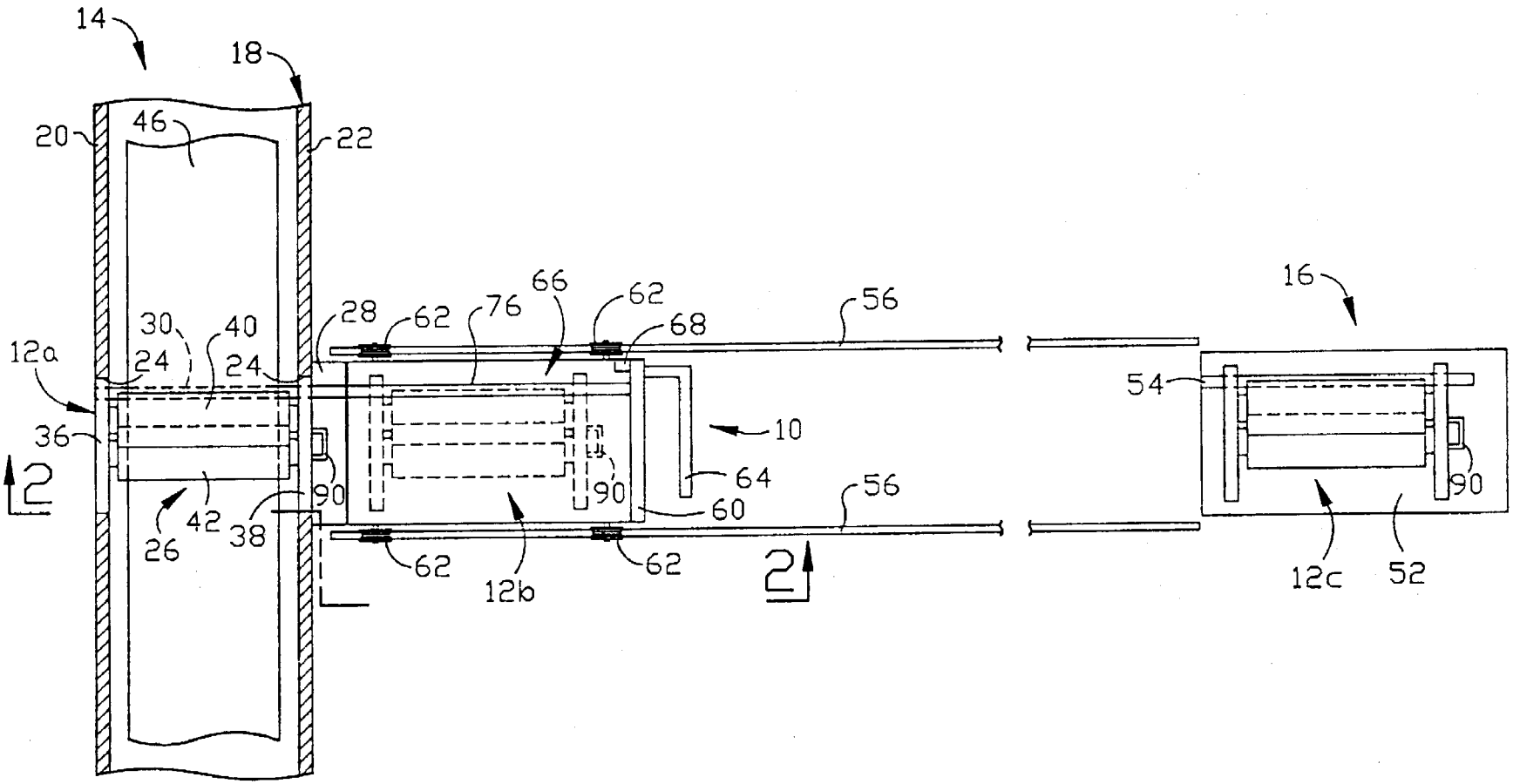
FIG. 1 is a schematic view of a printing facility, partially in section, and a printing cassette transfer cart in accordance with the present invention.

A printing cassette transfer cart 10 in accordance with the present invention and an associated printing facility are schematically illustrated in FIG. 1. The transfer cart 10 facilitates exchange of printing cassettes between a printing press 14 and a cassette storage facility 16 within the printing facility. FIG. 1 illustrates three cassettes 12*a*, 12*b*, and 12*c*. Cassette 12*a* is located in the printing press 14. Cassette 12*c* is located in the cassette storage facility 16. Cassette 12*b* is located on the transfer cart 10 adjacent the printing press 14.

The printing press 14 may have any suitable construction and is preferably an offset printing press. A frame 18 of the printing press 14 has two side frames 20 and 22 which are spaced apart and parallel to each other. Each of the side frames 20, 22 has an opening 24. The openings 24 are generally rectangular in shape and are aligned with each other.

A printing cassette location 26 is defined within the frame 18 of the printing press 14 between the side frames 20, 22 at the openings 24. A cassette loading platform 28 (FIG. 2) extends from the side frame 22, adjacent the lower edge of the opening 24. A guide rail 30 extends along the loading platform 28 and between the side frames 20, 22.

Each cassette 12*a*–12*c* has the same structural features and has the same function within the printing press 14. Each cassette includes two cassette sides 36 and 38. The cassette sides 36, 38 are plate-like and have the same shape as the openings 24 in the side frames 20, 22. When a cassette is in the printing press 14, the cassette sides 36, 38 are located in the openings 24 and are locked in place relative to the frame 18 by a suitable lock means (not shown).

Each cassette also includes a plate cylinder 40 located between the cassette sides 36, 38. The plate cylinder 40 is journalled for rotation about an axis relative to the cassette sides 36, 38, and thus rotates relative to the frame 18. An image is on the outer side of the plate cylinder 40 and the image corresponds to the image to be printed. The image may be formed on the plate cylinder circumference or may be on a thin printing plate wrapped around the plate cylinder as is known. Each cassette 12*a*–12*c* has a distinct image to be printed.

Each cassette also includes a blanket cylinder 42 located between the cassette sides 36, 38. The blanket cylinder 42 is journalled for rotation relative to the cassette sides, and thus rotates relative to the frame 18. A resilient blanket is mounted on the outer side of the blanket cylinder 42.

The printing press 14 has an inker assembly 32. The plate cylinder 40 is adjacent to the inker assembly 32 when the cassette is in the printing press 14. A motor and gears (not shown) rotate the plate and blanket cylinders 40 and 42 during a printing run. During rotation of the plate and blanket cylinders 40 and 42, ink is applied by the inker assembly 32 to the image on the plate cylinder 40. The ink image is transferred from the plate cylinder 40 to the blanket on the blanket cylinder 42, as will be understood by those skilled in the art.

An impression cylinder 34 is mounted between the side frames 20, 22 and is movable to a location in close proximity to the blanket cylinder 42. A nip 44 is defined by and between the adjacent blanket and impression cylinders 42 and 34. A web of printing stock material 46 (FIG. 1) is moved through the nip 44 (FIG. 2) during a printing run, and the ink image is transferred from the blanket cylinder 42 to the stock material.

The cassette storage facility 16 (FIG. 1) may have any suitable construction for storing a plurality of cassettes. For example, the storage facility 16 may have a plurality of shelves 52 (only one shown) for receiving the respective cassettes. Each of the shelves 52 has a guide rail 54 for guiding movement of the respective cassette onto and from the respective shelf 52.

A track 56 extends between the printing press 14 and the storage facility 16, and has any suitable construction. For example, the track 56 is illustrated (FIG. 1) as having a single pair of rails. However, the track 56 may have several branches to various areas of the storage facility 16.

The transfer cart 10 may have any suitable construction. In the preferred embodiment, the transfer cart 10 (FIG. 3) has a base 60 and four wheels 62. Each wheel 62 is adjacent to a corner of the base 60 and is configured to roll upon the track 56. A manually engageable handle 64 extends from the base 60. An operator 84 (FIG. 2) can grasp the handle 64 and can push or pull the transfer cart 10 along the track 56 between the printing press 14 and the storage facility 16.

A carriage 66 (FIG. 3) is located above the base 60 and has at least one vertical support post 68. A lower shelf 70 of the carriage 66 is fixed to a bottom of the support post 68. The lower shelf 70 is planar and a guide rail 72 extends along the top of the lower shelf. An upper shelf 74 of the carriage 66 is fixed to the support post 68 and is located above the lower shelf 70. The upper shelf 74 is similar to the lower shelf 70 and a guide rail 76 extends along the top of the upper shelf.

Figure 4:
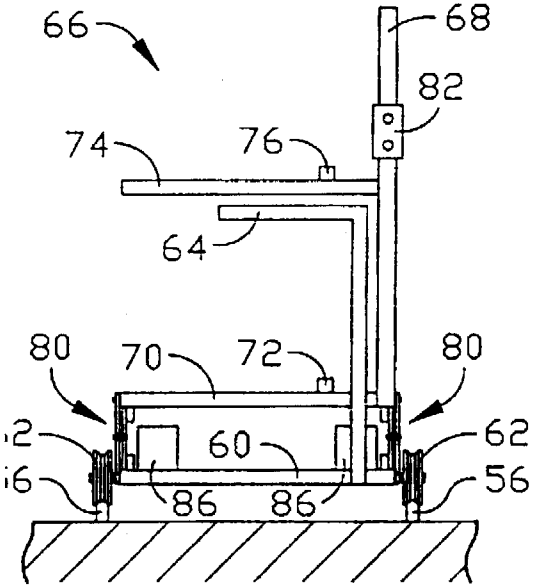
FIG. 4 is a view taken along line 4—4 in FIG. 3.

The support post 68 is located on one side of the shelves 70, 74 (FIG. 4) and a cassette (not shown in FIG. 4) can be slid onto or off of a respective shelf from either end of the respective shelf. The guide rails 72, 76 guide the sliding movement. Both shelves 70, 74 of the carriage 66 can receive a cassette and hold the cassette during movement of the transfer cart 10.

A lift mechanism 80 supports and carries the carriage 66 on the base 60. The lift mechanism 80 can move the carriage 66 relative to the base 60. The movement of the carriage 66 by the lift mechanism 80 is in a vertical direction.

The lift mechanism 80 may have two pairs of scissor-like cross-members. Each pair of cross-members (FIG. 3) has lower ends guided along portions of the base 60 and upper ends guided along portions of the lower shelf 70. A motor 86 drives the lower ends of the cross-members relatively toward or away from each other along the base 60.

The upper ends of the cross-members move vertically relative to the base 60 when the lower ends are moved. The carriage 66 is moved vertically with the upper ends of the cross-members. A control pad 82 controls the operation of the motor 86 of the lift mechanism 80. The control pad 82 is located at a suitable location on the transfer cart 10. The control pad 82 is operable by the operator 84 (FIG. 2) to cause the carriage 66 to move vertically.

Figure 2:
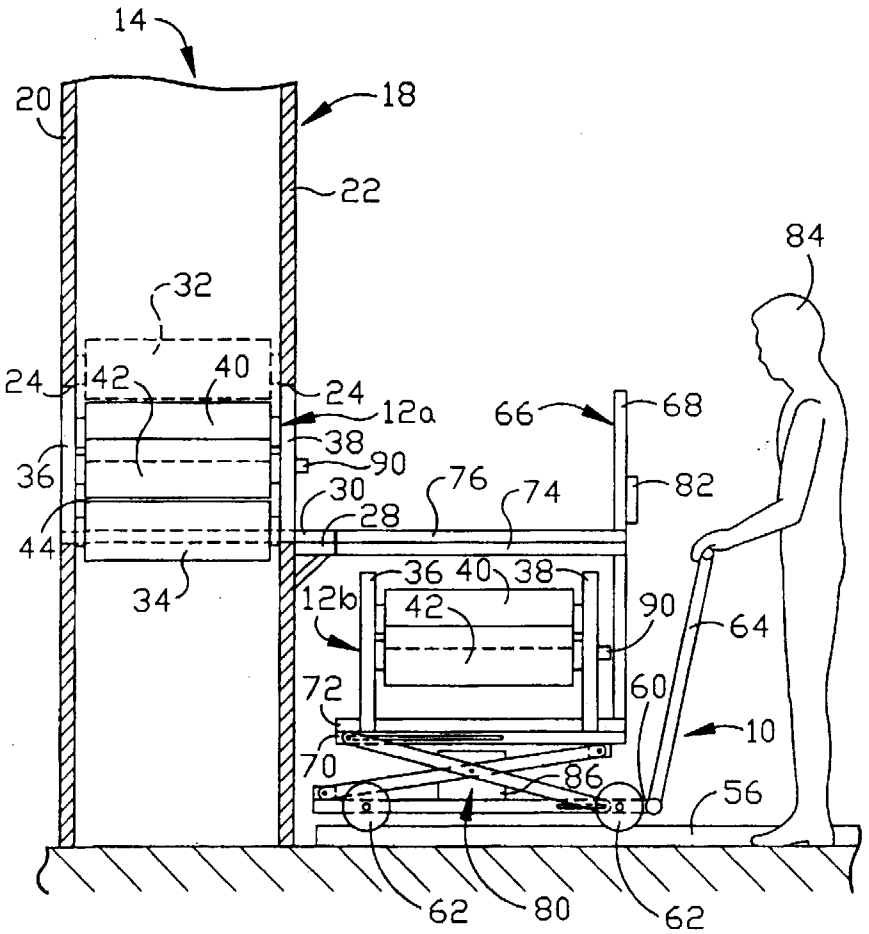
FIG. 2 is a view taken along line 2—2 in FIG. 1.
Figure 3:
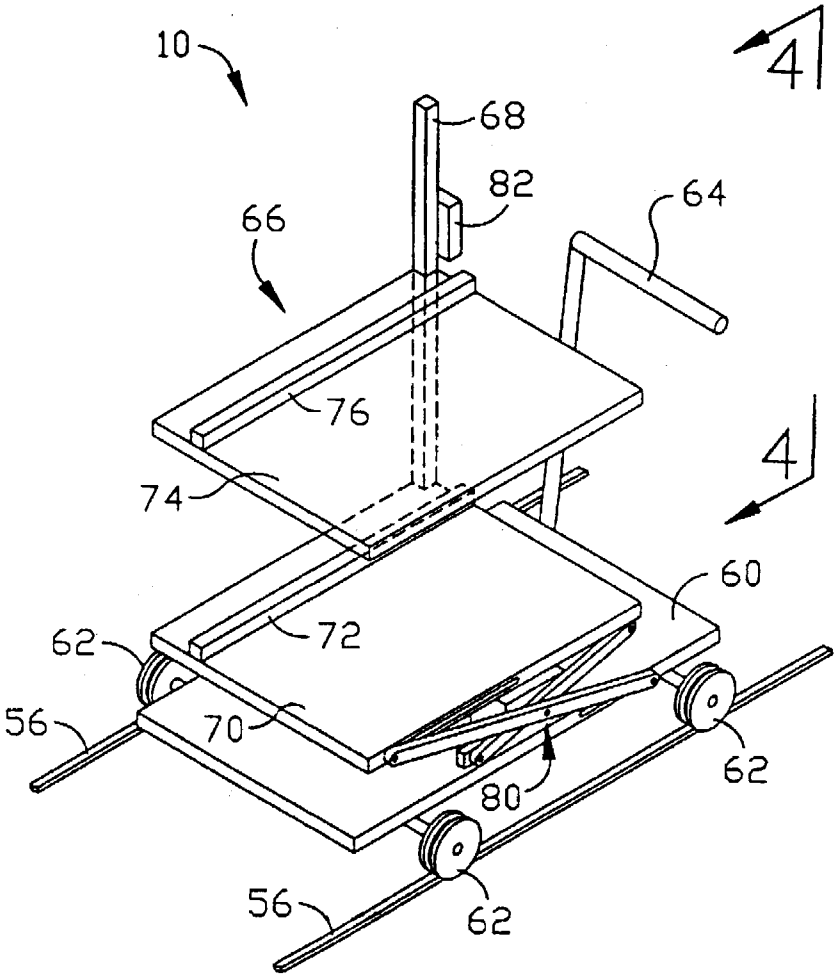
FIG. 3 is a schematic perspective view of the transfer cart shown in FIG. 2.

When it is desired to replace the cassette 12*a* (FIG. 1) in the printing press 14 with the cassette 12*b*, the operator 84 moves the transfer cart 10 to an appropriate location at the storage facility 16. The operator 84 moves the desired cassette 12*b* from its respective shelf 52 in the storage facility 16 onto one of the shelves 70, 74 of the carriage 66. In the illustrated embodiment, the cassette 12*b* is moved onto the lower shelf 70 (FIG. 2). The operator 84 moves the transfer cart 10 along the track 56 from the storage facility 16 to a position adjacent to the printing press 14. This cart movement is a delivery segment of a round trip of the transfer cart 10 between the storage facility 16 and the printing press 14. During the cart movement, the wheels 62 roll along the track 56 and the carriage 66, with the supported cassette 12*b*, is carried by the lift mechanism 80 and the base 60.

When the transfer cart 10 is at a location adjacent to the printing press 14, the one shelf 70, 74 which does not contain the cassette 12*b* is aligned with the loading platform 28 by moving the carriage 66 vertically via the lift mechanism 80. In the illustrated example, the upper shelf 74 is aligned with the loading platform 28 (FIG. 2). Operation of the printing press 14 is ceased, and the printing press 14 is readied for exchange of the cassettes. In particular, the impression cylinder 34 is moved away from the blanket cylinder 42 and the lock means holding the cassette 12*a* is unlocked.

Figure 5:
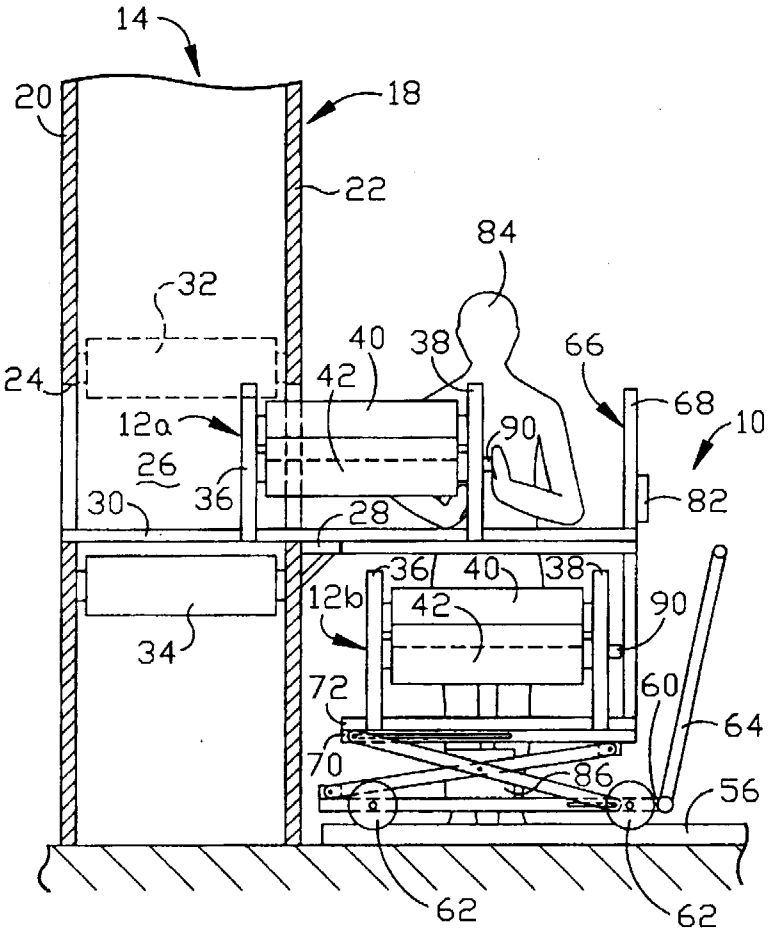
FIGS. 5–7 are views similar to FIG. 2, but with parts in different positions.
Figure 6:
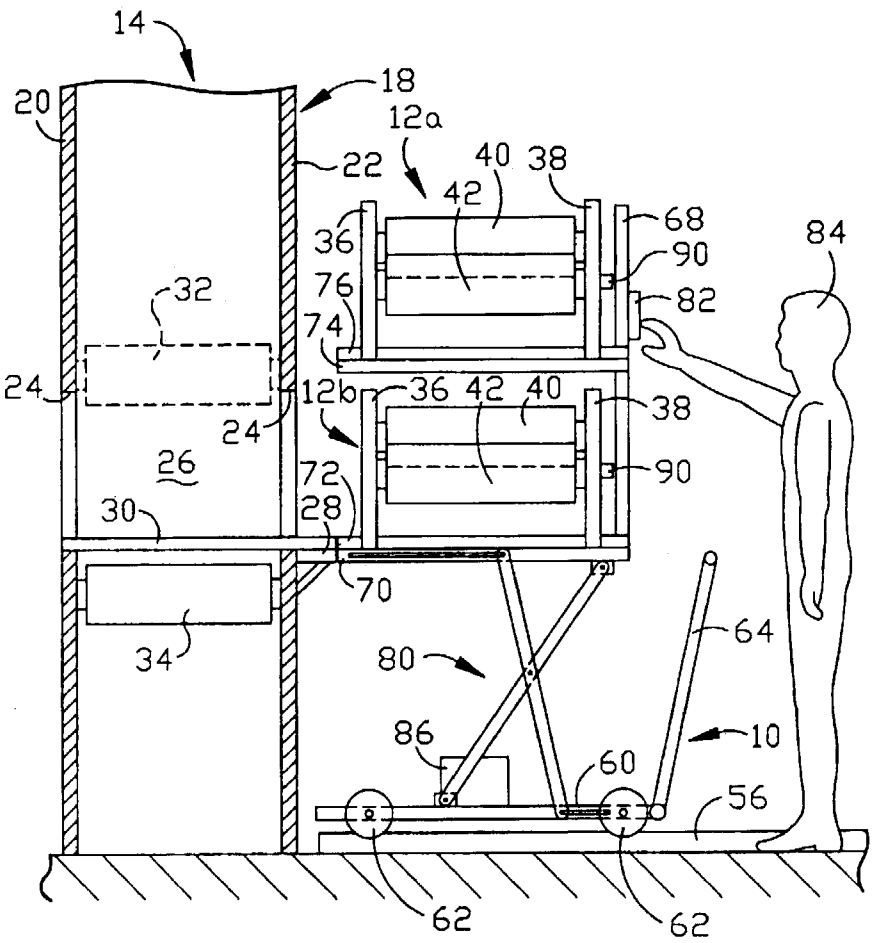

The operator 84 (FIG. 5) slides the cassette 12*a* along the guide rail 30 out from the printing press 14, across the loading platform 28 and onto the upper shelf 74. A handle 90 is provided on the cassette side 38 to facilitate movement of the cassette. The cassette 12*a* is moved along the upper shelf 74 and along its guide rail 76 until the cassette 12*a* is completely removed from the printing press 14 and completely located on the upper shelf 74. The removal of the cassette 12*a* from the printing press 14 and the movement of the cassette 12*a* onto the upper shelf 74 is done while the cassette 12*b* remains on the lower shelf 70. The operator 84 (FIG. 6) then operates the control pad 82 to cause the lift mechanism 80 to raise the carriage 66 to align the lower shelf 70 with the loading platform 28.

Figure 7:
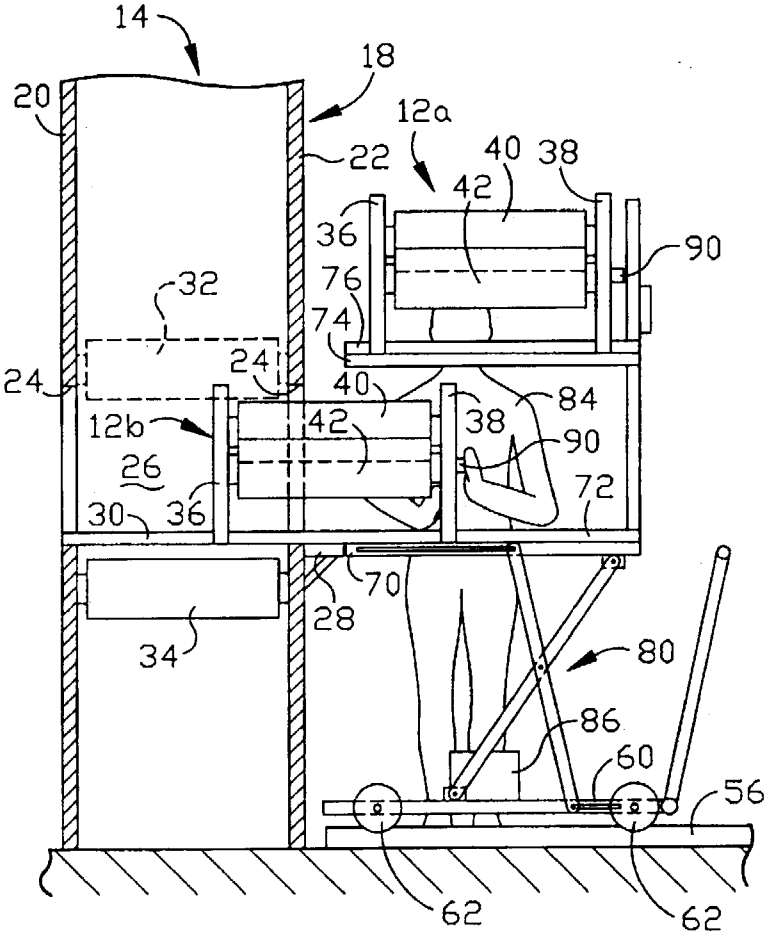

The replacement cassette 12*b* (FIG. 7) is moved by the operator 84 along the lower shelf 70 and its guide rail 76 onto the loading platform 28. The replacement cassette 12*b* is moved along the guide rail 30 into the printing press 14 until its cassette sides 36, 38 are located within the opening in the side frames 20, 22, respectively. The movement of the cassette 12*b* from the lower shelf 70 and into the printing press 14 is done while the cassette 12*a* remains on the upper shelf 74.

The cassette 12*b* is locked in position relative to the frame 18 by the lock means and the printing press 14 is readied for a new printing run. The impression cylinder 34 is moved into close proximity with the blanket cylinder 42 of the cassette 12*b* and the stock material 46 is fed through the nip 44 defined between the impression and blanket cylinders. The printing run is started, and the image on the plate cylinder 40 of the cassette 12*b* is printed onto the stock material 46.

The operator 84 can lower the carriage 66 with the cassette 12*a* on the upper shelf 74 for movement of the transfer cart 10 away from the printing press 14 to the storage facility 16. This cart movement is a return segment of the round trip of the transfer cart 10 between the storage facility 16 and the printing press 14. At the storage facility 16, the cassette 12*a* is moved from the upper shelf 74 of the carriage 66 onto a respective shelf 52 of the storage facility for later use. Maintenance work, such as cleaning and/or blanket replacement can be performed on the cassette 12*a* away from the printing press.

The transfer cart 10 increases the efficiency with which an exchange of cassettes, and a change of print images, can be accomplished, in that minimum handling of the cassettes needs to be performed in order to exchange cassettes.

From the above description of the invention, those skilled in the art will perceive improvements, changes and modifications. Such improvements, changes and modifications within the skill of the art are intended to be covered by the appended claims.

Having described the invention, the following is claimed:

1. An apparatus for facilitating exchange of printing cassettes in a printing press, the printing cassettes having respective images to be printed on material during operation of the printing press, said apparatus comprising:

first holding means for receiving a replacement printing cassette from a cassette storage facility;

transport means for carrying said first holding means and the replacement printing cassette received by said first holding means from the cassette storage facility to a transfer location adjacent to the printing press;

second holding means for receiving a replaceable printing cassette from a cassette location in the printing press while the replacement printing cassette is retained by said first holding means, said second holding means being located directly above said first holding means; and mover means for simultaneously moving said first and second holding means in a vertical direction between a first position in which said second holding means can receive the replaceable printing cassette from the cassette location in the printing press while said first holding means retains the replacement printing cassette directly underneath said second holding means and a second position in which the cassette location in the printing press can receive the replacement printing cassette from said first holding means while said second holding means retains said replaceable printing cassette received from the printing press directly above said first holding means.

2. An apparatus as set forth in claim 1, wherein said first and second holding means are first and second shelves, respectively.

3. An apparatus as set forth in claim 1, wherein said transport means includes a base which has a plurality of wheels.

4. An apparatus as set forth in claim 3, wherein said wheels are movable along a track which extends between the cassette storage facility and the printing press.

5. An apparatus as set forth in claim 3, including a manually engageable handle extending from said base for engagement by an operator.

6. An apparatus as set forth in claim 1, including a control means for controlling operation of said mover means.

7. An apparatus for facilitating exchange of printing cassettes in a printing press, the printing cassettes having respective images to be printed on material during operation of the printing press, said apparatus comprising:

first holding means for receiving a replacement printing cassette from a cassette storage facility;

transport means for carrying said first holding means and the replacement printing cassette received by said first holding means from the cassette storage facility to a transfer location adjacent to the printing press;

second holding means for receiving a replaceable printing cassette from a cassette location in the printing press while the replacement printing cassette is retained by said first holding means, said second holding means being located directly underneath said first holding means; and mover means for simultaneously moving said first and second holding means in a vertical direction between a first position in which said second holding means can receive the replaceable printing cassette from the cassette location in the printing press while said first holding means retains the replacement printing cassette directly above said second holding means and a second position in which the cassette location in the printing press can receive the replacement printing cassette from said first holding means while said second holding means retains said replaceable printing cassette received from the printing press directly underneath said first holding means.

8. An apparatus as set forth in claim 7, wherein said first and second holding means are first and second shelves, respectively.

* * * * *